US009233552B2

(12) United States Patent
Yahata

(10) Patent No.: US 9,233,552 B2
(45) Date of Patent: Jan. 12, 2016

(54) ERASING AND SORTING APPARATUS

(71) Applicants: KABUSHIKI KAISHA TOSHIBA, Tokyo (JP); TOSHIBA TEC KABUSHIKI KAISHA, Tokyo (JP)

(72) Inventor: Isao Yahata, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/181,294

(22) Filed: Feb. 14, 2014

(65) Prior Publication Data

US 2015/0231893 A1 Aug. 20, 2015

(51) Int. Cl.
*B41J 2/165* (2006.01)
*B41J 2/32* (2006.01)

(52) U.S. Cl.
CPC ..... *B41J 2/32* (2013.01)

(58) Field of Classification Search
None
See application file for complete search history.

(56) References Cited

U.S. PATENT DOCUMENTS

2010/0194839 A1 8/2010 Taguchi et al.
2011/0074086 A1 3/2011 Iguchi et al.
2011/0222130 A1* 9/2011 Iguchi et al. ..... 358/452
2011/0234721 A1 9/2011 Endo

FOREIGN PATENT DOCUMENTS

JP 2002245075 A 8/2002

* cited by examiner

*Primary Examiner* — Alejandro Valencia
(74) *Attorney, Agent, or Firm* — Patterson & Sheridan, LLP

(57) ABSTRACT

An erasing apparatus includes a sheet feeding unit from which a sheet is fed into the erasing apparatus, an erasing unit configured to perform an erasing processing on both surfaces of the sheet, a scanning unit configured to scan and generate image data of a bottom surface and a top surface of the sheet, a first storing unit, a second storing unit, and a controller. The controller is configured to determine, based on the image data, whether the bottom surface of the sheet is reusable and whether the top surface of the sheet is reusable. Further, the controller is configured to cause, if both the bottom and top surfaces have been subject to the erasing processing and are determined to be reusable, the sheet to be conveyed to one of the first and second storing units based on a both-sides-erased criteria.

9 Claims, 4 Drawing Sheets

ERASING AND SORTING APPARATUS

FIELD

Embodiments described herein relate to a technology of discharging a sheet subjected to an erasing processing.

BACKGROUND

Conventionally, there is an erasing apparatus which is capable of carrying out an erasing processing on a sheet having images formed with a color erasable material. After reading a surface of the sheet after the color erasing processing, such an erasing apparatus determines discharging destinations according to whether or not there is a residual image on the sheet.

DETAILED DESCRIPTION

An erasing apparatus according to an embodiment includes a sheet feeding unit from which a sheet is fed into the erasing apparatus, an erasing unit configured to perform an erasing processing on both surfaces of the sheet, a scanning unit configured to scan and generate image data of a bottom surface and a top surface of the sheet, a first storing unit, a second storing unit, and a controller. The controller is configured to determine, based on the image data, whether the bottom surface of the sheet is reusable and whether the top surface of the sheet is reusable. Further, the controller is configured to cause, if both the bottom and top surfaces have been subject to the erasing processing and are determined to be reusable, the sheet to be conveyed to one of the first and second storing units based on a both-sides-erased criteria.

Each embodiment of the present invention is described below with reference to accompanying drawings.

First Embodiment

Figure 1:
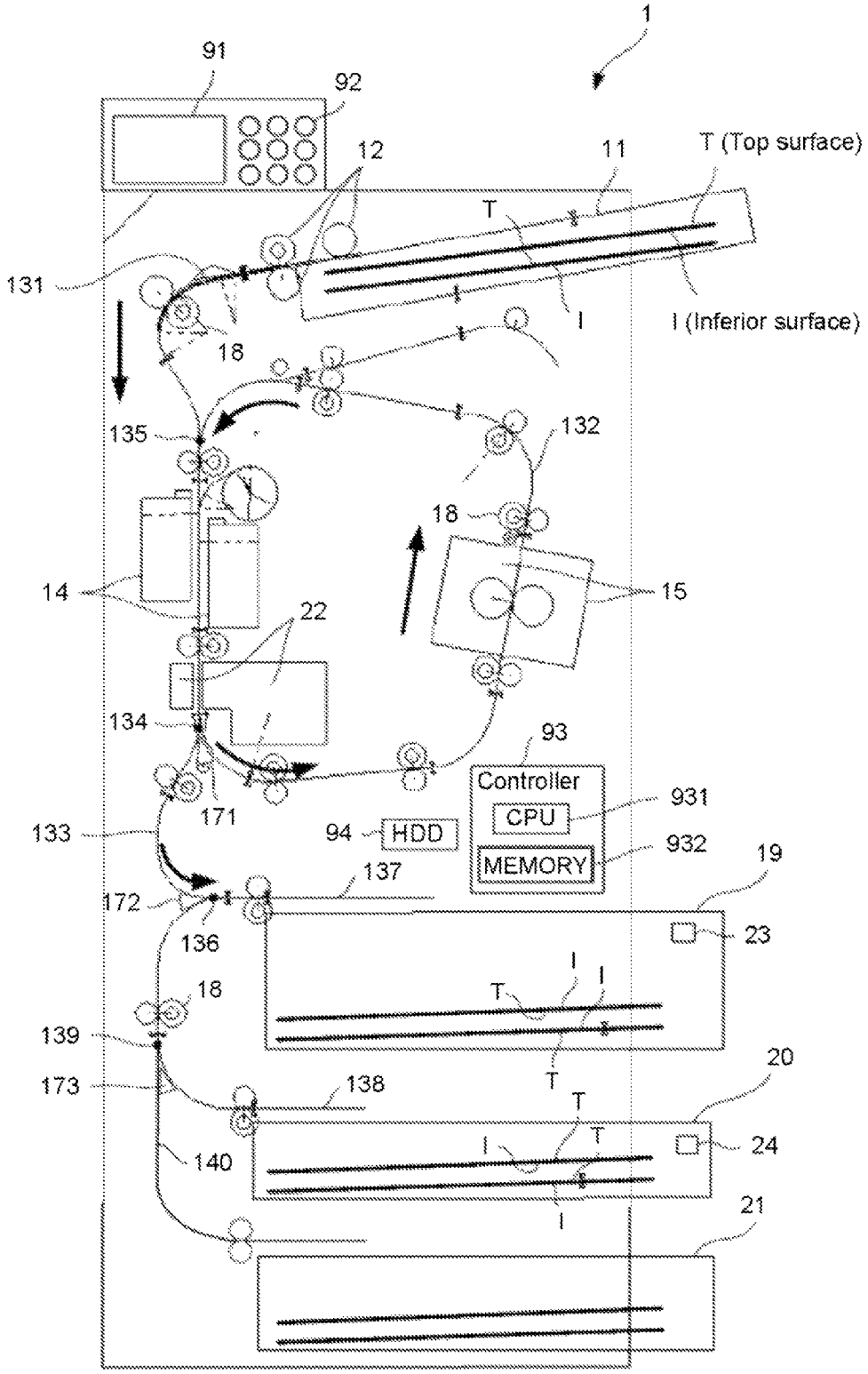
FIG. 1 is a diagram illustrating the entire configuration of an erasing apparatus.

FIG. 1 is a diagram illustrating the whole configuration of an erasing apparatus 1.

The erasing apparatus 1 carries out an erasing processing of erasing the color of an image formed on a sheet with an erasable material such as an erasable toner or an erasable ink or the like. The erasable material contains a color generation compound, a color developing agent, and a color erasing agent. For the color generation compound, for example, a leuco dye developing blue color can be used. For the color developing agent, for example, a phenol group can be used. For the color erasing agent, for example, a substance which is compatible with the color generation compound when being heated and has no affinity with the color developing agent can be used. The erasable material develops the color by the interaction of the color generation compound and the color developing agent. When the interaction of the color generation compound and the color developing agent is terminated by heat above an erasing temperature, the color-erasable material is subjected to the color erasing.

The erasing apparatus 1 comprises a paper feeding tray 11, a paper feeding section 12, a first to a third conveyance paths 131-133, a reading section 14, a mark printing section 22, an erasing section 15, sheet flappers 171-173, a conveyance roller 18, a first and a second tray 19 and 20, a reject tray 21, a first and a second sensors 23 and 24, a display section 91, an operation section 92, a controller 93, and an HDD 94.

Sheets on which images are formed with the erasable material are stacked on the paper feeding tray 11.

The paper feeding section 12 feeds, piece by piece, the sheets stacked on the paper feeding tray 11 to the first conveyance path 131.

The reading section 14 is arranged along the first conveyance path 131. The reading section 14 provided with a CCD (Charge Coupled Device) reads the images on two surfaces of a sheet which is fed from the paper feeding tray and not subjected to an erasing processing and the images on two surfaces of the sheet on which the erasing processing is carried out by the erasing section 15. The reading section 14 outputs image data to the HDD 94. The user can acquire the image data of the sheet not subjected to the erasing processing from the HDD 94. The reading section 14 further has a function of reading reuse marks, which are printed on two surfaces of the sheet not subjected to the erasing processing and will be describe later. The reuse mark represents that an image on the surface of the sheet has been erased.

The mark printing section 22 is arranged along the first conveyance path 131. The mark printing section 22 is capable of printing the reuse mark on two surfaces of a sheet with a non-erasable material.

The second conveyance path 132 extends from a branching point 134, which is downstream with respect to the reading section 14 in a sheet conveyance direction along the first conveyance path 131. Further, the second conveyance path 132 merges with the first conveyance path 131 at a mergence point 135, which is upstream with respect to the reading section 14 in the sheet conveyance direction. The third conveyance path 133 also extends from the branching point 134.

The erasing section 15 is arranged along the second conveyance path 132 to erase the images on two surfaces of a sheet by heating the images.

The sheet flappers 171-173 are located at the branching point 134 and the branching points 136 and 139 of the third conveyance path 133 and switch the conveyance destination of a sheet.

The conveyance rollers 18 are located at proper positions along the first to third conveyance paths 131-133 and convey a sheet.

The third conveyance path 133 comprises a reversal conveyance path 137, a switchback conveyance path 138, and a conveyance path 140.

Along, the reversal conveyance path 137, a sheet passing the erasing section 15 and the reading section 14 is conveyed to the first tray 19.

The switchback conveyance path 138 extends from a branching point 136 in the reversal conveyance path 137 towards the second tray 20. A sheet in the reversal conveyance path 137 at the side of the first tray 19 with respect to the branching point 136 is conveyed to the switchback conveyance path 138.

The conveyance path 140 extends from a branching point 139 in the switchback conveyance path 138 towards the reject tray 21.

The controller 93 comprises a CPU (Central Processing Unit) 931 and a memory 932 and controls the whole erasing apparatus 1.

Hereinafter, the top surface of a sheet on the paper feeding tray 11 is appended a mark T (Top surface) while the inferior surface of the sheet is appended a mark I (Inferior surface).

A reusable sheet discharged from the reversal conveyance path 137 is stacked on the first tray 19. If there is an image on the top surface T of a sheet on the paper feeding tray 11 but there is no image on the inferior surface I of the sheet, the sheet is discharged to the first tray 19 with the inferior surface I of the sheet facing upward.

A reusable sheet discharged from the switchback conveyance path 138 is stacked on the second tray 20. If there is an image on the inferior surface I of a sheet on the paper feeding tray 11 but there is no image on the top surface T of the sheet, the sheet is discharged to the first tray 20 with the top surface T of the sheet facing upward.

A non-reusable sheet discharged from the conveyance path 140 is stacked on the reject tray 21.

The first sensor 23 detects the sheet loading amount of the first tray 19.

The second sensor 24 detects the sheet loading amount of the second tray 20.

The display section 91 is a touch panel and the like and displays set information, operation status and log information of the erasing apparatus 1, and a notice to the user.

The operation section 92 comprises buttons and keys, receives an operation input to start a erasing processing and instructions on functional actions of the erasing apparatus 1 from the user.

Figure 2:
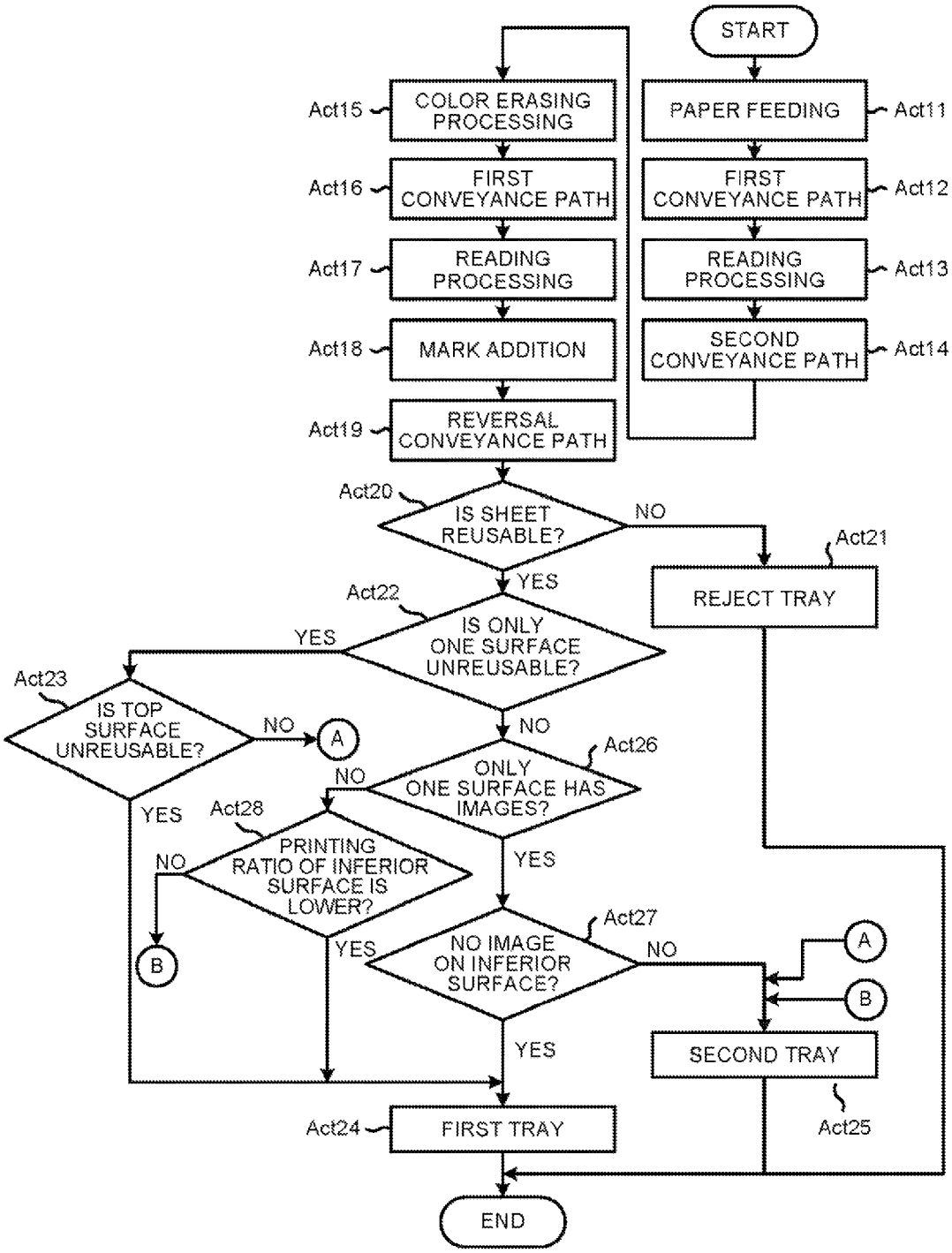
FIG. 2 is a flowchart illustrating the flow of an erasing processing carried out on a sheet by a controller.

The flow of the erasing processing carried out by the controller 93 for a sheet is described below with reference to the flowchart of FIG. 2 and FIG. 1. The processing is carried out by the CPU 931 by reading programs stored in the memory 932.

The controller 93 controls the paper feeding section 12 to pick up a sheet from the paper feeding tray 11 (ACT 11) and causes the sheet to be fed to the first conveyance path 131 (ACT 12). After the reading section 14 reads two surfaces, that is the T and the I, of the sheet not subjected to the erasing processing (ACT 13), The controller 93 controls the conveyance roller 18 to convey the sheet to the second conveyance path 132 (ACT 14). Further, the top surface T of a sheet on the paper feeding tray 11 is a sheet surface at the side of a sheet newly fed to the paper feeding tray 11, and the inferior surface I of the sheet on the paper feeding tray 11 is a surface on the backside of the top surface T of the sheet.

The controller 93 controls the erasing section 15 to erase the color of the image on the sheet (ACT 15) and then causes the sheet to be conveyed to the first conveyance path 131 (ACT 16), and the top surface T and the inferior surface I of the sheet subjected to the erasing processing are read by the reading section 14 (ACT 17). Further, based on the reading result on the top surface T and the inferior surface I of the sheet not subjected to the erasing processing, the controller 93 may control the erasing section 15 to carry out the erasing processing only for the surface of the sheet having an image.

The controller 93 controls the mark printing section 22 to print, based on the image data obtained before the erasing processing, a reuse mark on the surface having an image before the erasing processing with the non-erasable material (ACT 18). The reuse mark is printed on, for example, the edge of a sheet surface before each erasing processing. Thus, the number of the reuse marks represents the number of times images on the surface of the sheet have been erased (number of reuse).

The controller 93 causes the sheet to be conveyed from the branching point 172 of the reversal conveyance path 137 towards the first tray 19 and stays on standby until the determination processing of the discharging destination of the sheet is ended (ACT 19).

The controller 93 determines whether or not a sheet surface is reusable based on the image data obtained before the erasing processing and the image data obtained after the erasing processing (ACT 20).

The controller 93 determines the sheet surface to be non-reusable in the following cases:

(1) the controller 93 determines that there is a fracture or breakage on the sheet surface based on the image data obtained before the erasing processing and the image data obtained after the erasing processing;

(2) the controller 93 determines that there is an erasing residual on the sheet surface based on the image data obtained after the erasing processing; or (3) the controller 93 determines that the printing ratio (i.e., toner coverage ratio) of the sheet surface is higher than a threshold value based on the image data obtained before the erasing processing.

When the controller 93 determines that the top surface T and the inferior surface I of the sheet are both non-reusable (NO in ACT 20), the controller 93 causes the sheet to be conveyed from the reversal conveyance path 137 to the switchback conveyance path 138. Then, the controller 93 causes the sheet to be discharged to the reject tray 21 from the conveyance path 140 through the switchback conveyance path 138 (ACT 21).

When the controller 93 determines that the top surface T of the sheet on the paper feeding tray 11 is non-reusable and the inferior surface I of the sheet is reusable (YES in ACT 20, ACT 22, and ACT 23), the controller 93 causes the sheet to be discharged to the first tray 19 from the reversal conveyance path 137 (ACT 24).

When the controller 93 determines that the inferior surface I of the sheet on the paper feeding tray 11 is non-reusable and the top surface T of the sheet is reusable (NO in ACT 23), the controller 93 causes the sheet to be conveyed from the reversal conveyance path 137 to the switchback conveyance path 138 and discharged to the second tray 20 (ACT 25).

In ACT 23-ACT 25, the controller 93 causes the sheet to be discharged to the first or second tray 19 or 20 such that the reusable surface of the sheet faces upward in the first or second tray 19 or 20.

Further, the top surface (a first surface, the upper side shown in FIG. 1) of the first tray 19 or second tray 20 is a sheet surface on which a sheet newly discharged to the first tray 19 or second tray 20 is placed, and the inferior surface (a second surface, the lower side shown in FIG. 1) of the first tray 19 or second tray 20 is a side opposite to the top surface.

When the controller 93 determines that the both surfaces are reusable (NO in ACT 22) and that based on the image data obtained before the erasing processing, only the top surface T of the sheet on the paper feeding tray 11 has had an image and the inferior surface I of the sheet has had no image (YES in ACT 26, YES in ACT 27) before the erasing processing, the controller 93 causes the sheet to be discharged to the first tray 19 (ACT 24).

When the controller 93 determines that only the inferior surface I of the sheet on the paper feeding tray 11 has had an image and the top surface T of the sheet has had no image (NO in ACT 27) before the erasing processing, the controller 93 causes the sheet to be discharged to the second tray 20 (ACT 25).

In ACTs 26, 27, 24, and 25, the controller 93 causes the sheet to be discharged to the first tray 19 or second tray 20 such that the surface having no image, that is, the surface preferable to be reused, of the sheet faces upward in the first tray 19 or second tray 20.

When the controller 93 determines that both surfaces of the sheet have had an image (NO in ACT 26) and the printing ratio of the inferior surface I of the sheet on the paper feeding tray 11 has been lower than that of the top surface T based on the image data obtained before the erasing processing (YES in ACT 28), the controller 93 causes the sheet to be discharged to the first tray 19 (ACT 24).

When the controller 93 determines that the printing ratio of the top surface T of the sheet on the paper feeding tray 11 has been lower than that of the inferior surface I based on the image data obtained before the erasing processing (NO in ACT 28), the controller 93 causes the sheet to be conveyed to the second tray 20 (ACT 25).

In Acts 26, 28, 24, and 25, the controller 93 determines a surface of the sheet on the paper feeding tray 11 having a lower printing ratio as a surface having no image and determines the surface to be a surface preferable to be reused. Then, the controller 93 controls the sheet to be discharged to the first tray 19 or second tray 20 such that the surface having the lower printing ratio faces upward in the first tray 19 or second tray 20.

Second Embodiment

Figure 3:
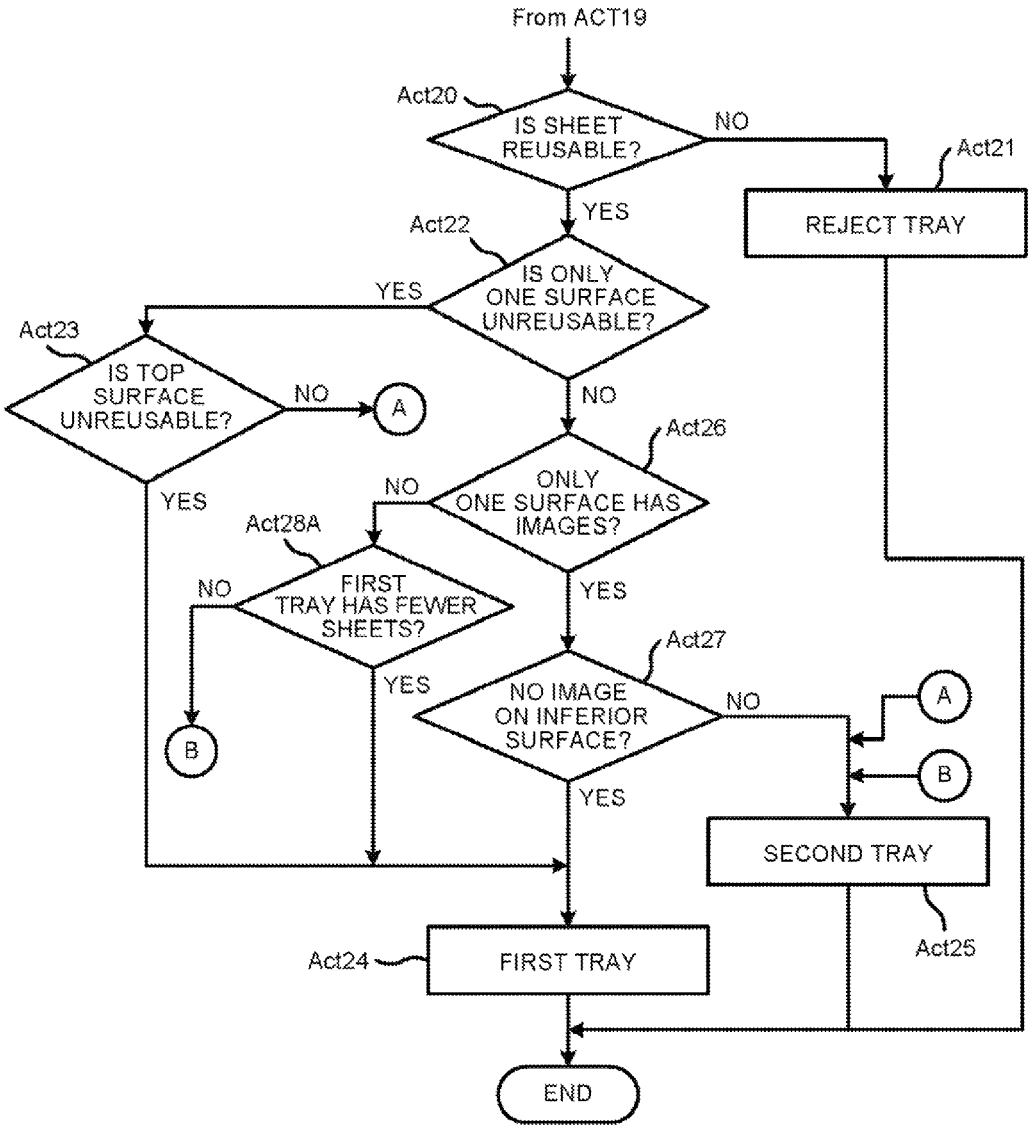
FIG. 3 is a flowchart illustrating another example of an erasing processing carried out on a sheet.

The flow of an erasing processing carried out by the controller 93 is described below with reference to the flowchart of FIG. 3. The embodiment is different from the first embodiment in ACT 28A. In ACT 28A, like in the first embodiment, two surfaces of the sheet subjected to the erasing processing are both determined to be reusable, and it is determined that based on the image data obtained before the erasing processing, the sheet not subjected to the erasing processing has had images on both surfaces of the sheet, i.e., top surface T and inferior surface I (NO in ACT 26).

In this state, the controller 93 determines that which one of the first and the second tray 19 and 20 storing fewer sheets based on the output signals of the first and second sensor 23 and 24 which detects the sheet loading amount of the first and the second tray 19 and 20, respectively (ACT 28A).

The controller 93 causes the sheet which has had images on both surfaces of the sheet, top surface T and inferior surface I, before the erasing processing to be conveyed to the one of the first and the second tray 19 and 20 storing fewer sheets (ACTs 24, 25).

Third Embodiment

Figure 4:
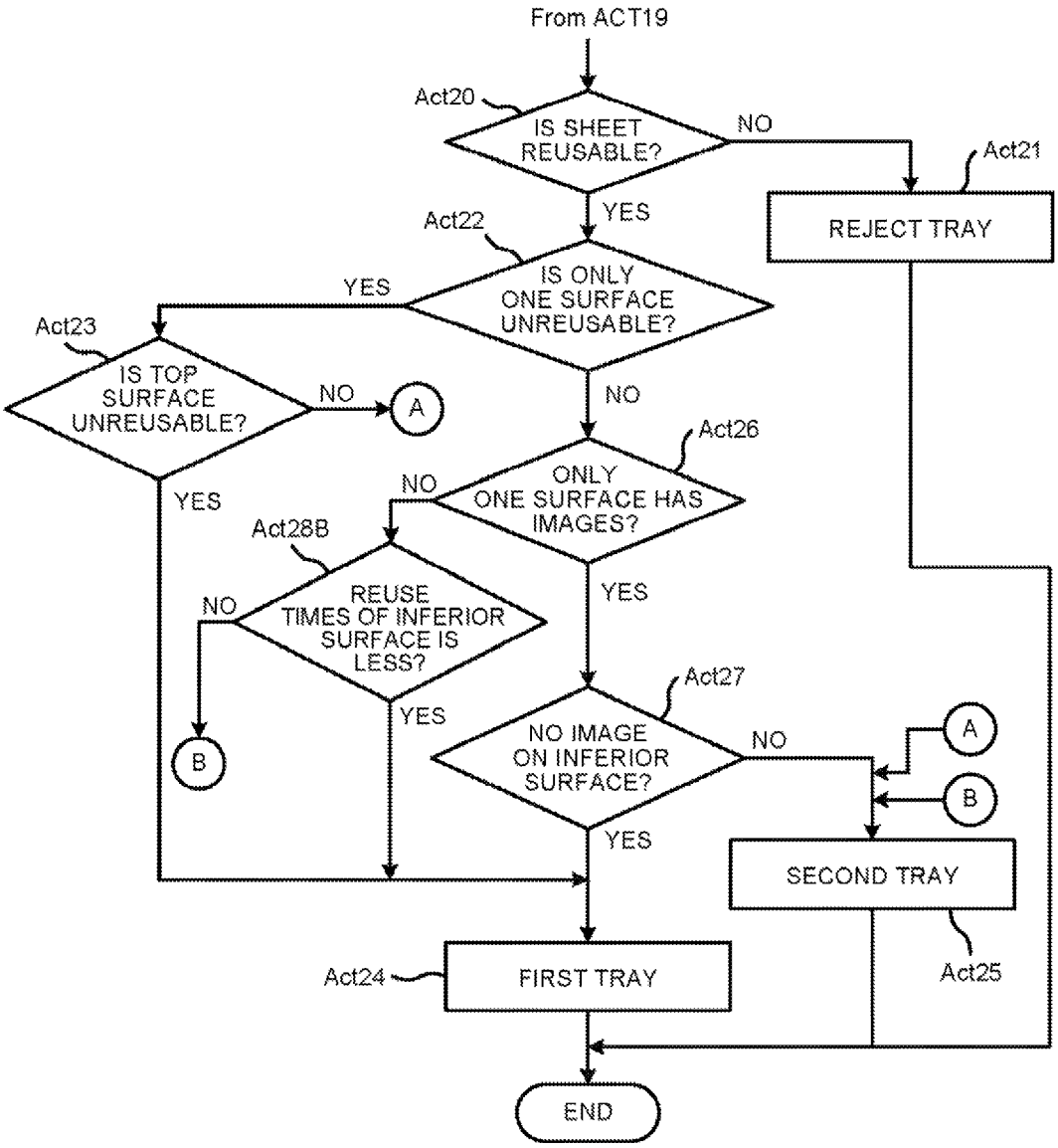
FIG. 4 is a flowchart illustrating another example of an erasing processing carried out on a sheet.

The flow of the erasing processing carried out by the controller 93 for a sheet is described below with reference to the flowchart of FIG. 4. The embodiment is different from the first embodiment in ACT 28B. In ACT 28B, like in the first embodiment, two surfaces of the sheet subjected to the erasing processing are both determined to be reusable, and it is determined that based on the image data obtained before the erasing processing, the sheet before the erasing processing has had images on both surfaces T and I (NO in ACT 26).

In this state, the controller 93 determines, based on the reuse marks on two surfaces T and I in the image data of the two surfaces T and I of the sheet before the erasing processing, whether or not the number of reuse of the inferior surface I of the sheet on the paper feeding tray 11 is smaller than that of the top surface T (ACT 28B).

When the controller 93 determines that the number of reuse of the inferior surface I of the sheet on the paper feeding tray 11 is smaller than that of the top surface T (YES in ACT 28B), the controller 93 causes the sheet to be discharged to the first tray 19 (ACT 24).

When the controller 93 determines that the number of reuse of the top surface T of the sheet on the paper feeding tray 11 is smaller than that of the inferior surface I (NO in ACT 28B), the controller 93 causes the sheet to be discharged to the second tray 20 (ACT 25).

In ACTs 28B, 24, and 25, the controller 93 causes the sheet on the paper feeding tray 11 to be discharged to the first tray 19 or second tray 20 such that the surface having a smaller number of reuse times, that is, the surface preferable to be reused to the opposite surface, faces upward in the first tray 19 or second tray 20. Further, it may be determined that the reuse times of the top surface T of the sheet on the paper feeding tray 11 is less than that of the inferior surface I of the sheet.

If the erasing processing is carried out for a sheet one surface of which is entirely formed with an image with the erasable material and for a sheet surface on which images has been repeatedly formed with the erasable material, then erasing residuals and specks of an image are likely to remain after the erasing processing.

For this reason, one surface of a sheet is sometimes more suitable to be reused than the other one when images are formed on the both surface of the sheet with the erasable material.

However, if the erasing apparatus simply discharges a sheet on both surfaces of which images are formed to a discharging tray after carrying out the erasing processing for the sheet, the surface of the sheet preferable to be reused is discharged randomly facing the top surface side or the inferior surface side of the discharging tray.

In view of this problem, in the embodiment, a sheet on the paper feeding tray 11 is discharged with the surface lower in printing ratio and less in reuse times and preferable to be reused facing one side (the top surface side of the discharging trays 19 and 20) of the discharging trays 19 and 20, and, thus, it is user-friendly.

In each of the embodiments above, a sheet is discharged to the first tray 19 or second tray 20 such that the surface preferable to be reused faces upward in the first tray 19 or second tray 20. however, by changing the configurations of the conveyance paths and the control over the conveyance of a sheet, a sheet may also be discharged to the first tray 19 or second tray 20 such that the surface preferable to be reused faces downward in the first tray 19 or the second tray 20.

In each of the embodiments above, the erasable material is an erasable toner carrying out erasing by heating, and the erasing section is configured to erase the color of the erasable material by heating a sheet. However, the erasable material may be a photodegradation material which is decomposed when radiated with light such as near infrared. In this case, the erasing section may be configured to decompose the erasable material by radiating a sheet with near infrared. Further, the erasable material may be a color material which may be dipped into a processing solution to be peeled from the sheet. In this case, the erasing section may be configured to dip a sheet into a processing solution to peel the erasable material.

Further, the following sheet discharging method according to a color erasing apparatus can be provided in each of the embodiments above.

1. A method for discharging a sheet according to a color erasing apparatus which comprises a color erasing section capable of carrying out a color erasing processing for two surfaces of a sheet on which images are formed with a color erasable material, a reading section for reading the two surfaces of the sheet, a paper feeding tray and a first and a second tray, wherein for a sheet conveyed from the paper feeding tray, the reading section reads two surfaces of the sheet on which images are formed with the color erasable material;

the color erasing section carries out a color erasing processing for the two surfaces of the sheet;

whether or not the printing ratio of the inferior surface of a sheet on the paper feeding tray is lower than that of the top surface of the sheet is determined based on the image data acquired by the reading section;

If the printing ratio of the inferior surface of the sheet on the paper feeding tray is determined to be lower than that of the top surface of the sheet, the sheet is discharged to the first tray with the inferior surface thereof facing either of the top surface side and the inferior surface side of the first tray; and if the printing ratio of the top surface of the sheet on the paper feeding tray is determined to be lower than that of the inferior surface, the sheet is discharged to the second tray with the top surface thereof facing either of the top surface side and the inferior surface side of the second tray.

2. A method for discharging a sheet according to a color erasing apparatus which comprises a color erasing section capable of carrying out a color erasing processing for two surfaces of a sheet on which images are formed with a color erasable material, a reading section for reading the two surfaces of the sheet, a paper feeding tray, a first and a second tray and a first and a second sensors for detecting the sheet loading amount of the first and the second tray, wherein for a sheet conveyed from the paper feeding tray, the reading section reads two surfaces of the sheet at least one surface of which an image is formed with a color erasable material;

the color erasing section carries out a color erasing processing for the image;

whether or not the top surface and the inferior surface of the sheet on the paper feeding tray has an image is determined based on the image data acquired by the reading section;

if it is determined that only the top surface has an image and the inferior surface has no image, the sheet is discharged to the first tray with the inferior surface thereof facing either of the top surface side and the inferior surface side of the first tray;

if it is determined that the top surface has no image, the sheet is discharged to the second tray with the top surface thereof facing either of the top surface side and the inferior surface side of the second tray; and if it is determined that both surfaces of the sheet have an image, the sheet is discharged to the one of the first and the second tray having less sheets;

3. A method for discharging a sheet according to a color erasing apparatus which comprises a color erasing section capable of carrying out a color erasing processing for two surfaces of a sheet on which images are formed with a color erasable material, a reading section for reading the reuse times marks that are on two surfaces of the sheet to represent the reuse times of the sheet, a paper feeding tray and a first and a second tray, wherein the reading section reads each reuse times mark on two surfaces of a sheet conveyed from the paper feeding tray;

the color erasing section carries out a color erasing processing for the two surfaces of the sheet;

whether or not the reuse times of the inferior surface of the sheet on the paper feeding tray is lower than that of the top surface of the sheet is determined based on the reuse times marks on the two surfaces of the sheet;

if it is determined that the reuse times of the inferior surface is lower than that of the top surface, the sheet is discharged to the first tray with the inferior surface thereof facing either of the top surface side and the inferior surface side of the first tray; and if it is determined that the reuse times of the top surface of the sheet on the paper feeding tray is lower than that of the inferior surface, the sheet is discharged to the second tray with the top surface thereof facing either of the top surface side and the inferior surface side of the second tray.

The sequence of the processing carried out in the embodiments may be different from that exemplarily given here.

As stated above in detail, according to the technology disclosed herein, a technology of discharging a sheet subjected to a color erasing processing is provided.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An erasing apparatus, comprising:

a sheet feeding unit;

an erasing unit configured to perform an erasing processing on both surfaces of a sheet fed from the sheet feeding unit;

a scanning unit configured to scan and generate image data of a bottom surface and a top surface of the sheet;

a first storing unit;

a second storing unit; and a controller configured to:

determine, based on the image data, whether the bottom surface of the sheet is reusable and whether the top surface of the sheet is reusable, cause, if both the bottom and top surfaces have been subjected to the erasing processing and are determined to be reusable, the sheet to be conveyed to one of the first and second storing units based on a both-sides-erased criteria, and cause, if only one of the bottom and top surfaces has been subjected to the erasing processing and is determined to be reusable and if the other of the surfaces not subjected to the erasing processing is determined to be reusable, the sheet to be conveyed to one of the first and second storing units based on which of the bottom and top surface has been subjected to the erasing processing.

2. The erasing apparatus according to claim 1, wherein the both-sides-erased criteria includes whether or not a printing ratio of the bottom surface is smaller than a printing ratio of the top surface.

3. The erasing apparatus according to claim 1, wherein the both-sides-erased criteria includes whether or not a number of sheets stored in the first storing unit is smaller than a number of sheets stored in the second storing unit.

4. The erasing apparatus according to claim 1, wherein the both-sides-erased criteria includes whether or not a number of times the bottom surface has been subjected to an erasing processing is smaller than a number of times the top surface has been subjected to the erasing processing.

5. The erasing apparatus according to claim 1, wherein the scanning unit is configured to scan and generate image data of the bottom surface and the top surface of the sheet both before and after the erasing processing, and wherein the controller is configured to:

determine that a surface of the sheet has been subjected to the erasing processing based on the image data of the surface before the erasing processing, and determine, based on the image data of the surfaces after the erasing processing, whether the bottom surface of the sheet is reusable and whether the top surface of the sheet is reusable.

6. The erasing apparatus according to claim 1, further comprising:

a third storing unit, wherein the controller is configured to cause the sheet to be conveyed to the third storing unit if both top and bottom surfaces of the sheet are determined to be not reusable.

7. The erasing apparatus according to claim 1, wherein the controller is configured to cause the sheet to be conveyed:

to the first storing unit, if the both-sides-erased criteria is met, to the second storing unit, if the both-sides-erased criteria is not met, to the first storing unit, if only the top surface has been subjected to the erasing processing and both the top and bottom surfaces are determined to be reusable, and to the second storing unit, if only the bottom surface has been subjected to the erasing processing and both the top and bottom surfaces are determined to be reusable.

8. The erasing apparatus according to claim 1, wherein the controller is configured to cause, if only one of the bottom and top surfaces is determined to be reusable, the sheet to be conveyed to one of the first and second storing units based on which of the bottom and top surface is determined to be reusable.

9. The erasing apparatus according to claim 8, wherein the controller is configured to cause the sheet to be conveyed:

to the first storing unit, if the both-sides-erased criteria is met, to the second storing unit, if the both-sides-erased criteria is not met, to the first storing unit, if only the bottom surface is determined to be reusable, and to the second storing unit, if only the top surface is determined to be reusable.

* * * * *